US008371574B2

(12) United States Patent
Ichikawa et al.

(10) Patent No.: US 8,371,574 B2
(45) Date of Patent: Feb. 12, 2013

(54) SHEET FEEDING DEVICE AND IMAGE FORMING APPARATUS

(75) Inventors: Hiroshi Ichikawa, Aichi (JP); Yohei Shibata, Aichi (JP)

(73) Assignee: Brother Kogyo Kabushiki Kasiha, Aichi-Ken (JP)

( * ) Notice: Subject to any disclaimer, the term of this patent is extended or adjusted under 35 U.S.C. 154(b) by 0 days.

(21) Appl. No.: 12/986,465

(22) Filed: Jan. 7, 2011

(65) Prior Publication Data

US 2011/0187047 A1 Aug. 4, 2011

(30) Foreign Application Priority Data

Jan. 29, 2010 (JP) ..... 2010-019042

(51) Int. Cl.
*B65H 1/12* (2006.01)
*B65H 3/56* (2006.01)

(52) U.S. Cl. ..... 271/160; 271/169

(58) Field of Classification Search ..... 271/167, 271/169, 170, 145
See application file for complete search history.

(56) References Cited

U.S. PATENT DOCUMENTS

| | | | | |
|---|---|---|---|---|
| 4,595,191 | A * | 6/1986 | Uchiyama et al. | 271/170 |
| 5,320,338 | A * | 6/1994 | Shinohara et al. | 271/164 |
| 5,934,667 | A * | 8/1999 | Miki | 271/152 |
| 7,104,539 | B2 * | 9/2006 | Shimoyama | 271/167 |
| 7,624,979 | B2 * | 12/2009 | Masutani | 271/167 |
| 2009/0243206 | A1 * | 10/2009 | Ueyama | 271/264 |

FOREIGN PATENT DOCUMENTS

| | | | |
|---|---|---|---|
| JP | 06-191655 | | 7/1994 |
| JP | 06-336342 | | 12/1994 |
| JP | 08-080650 | | 3/1996 |
| JP | 08080650 | A * | 3/1996 |
| JP | 2009-234690 | | 10/2009 |

OTHER PUBLICATIONS

Notification of Reasons for Rejection in the Japanese counterpart application No. 2010-019042 mailed Oct. 4, 2011.
Notification of Reasons for Rejection for corresponding Japanese Patent Appalication 2010-019042, mailed Jan. 10, 2012.

* cited by examiner

*Primary Examiner* — Patrick Cicchino
(74) *Attorney, Agent, or Firm* — Banner & Witcoff, Ltd.

(57) ABSTRACT

A sheet feeding device is provided. The sheet feeding device includes a body, a sheet cassette, a lifting plate, which is movable to an uplifted position when the sheet cassette is in the body and to a lowered position when the sheet cassette is outside the body, and uplifts the stack of sheets according to the uplifting movement thereof, a feeder to pick up and feed a topmost sheet, and a restrictive member, which is movable in association with the movement of the lifting plate. The restrictive member is in a restrictive position, in which at least a restricting part of the restrictive member is arranged over the stack of sheets, when the lifting plate is in the lowered position. The restrictive member is in a retracted position, in which the restrictive member is retracted off from the stack of sheets, when the lifting plate is in the uplifted position.

17 Claims, 6 Drawing Sheets

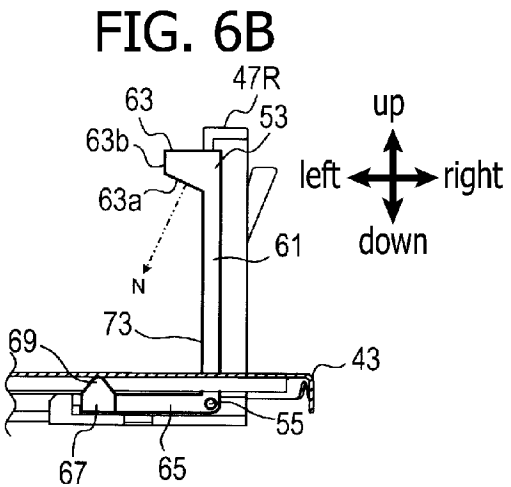
FIG. 6B
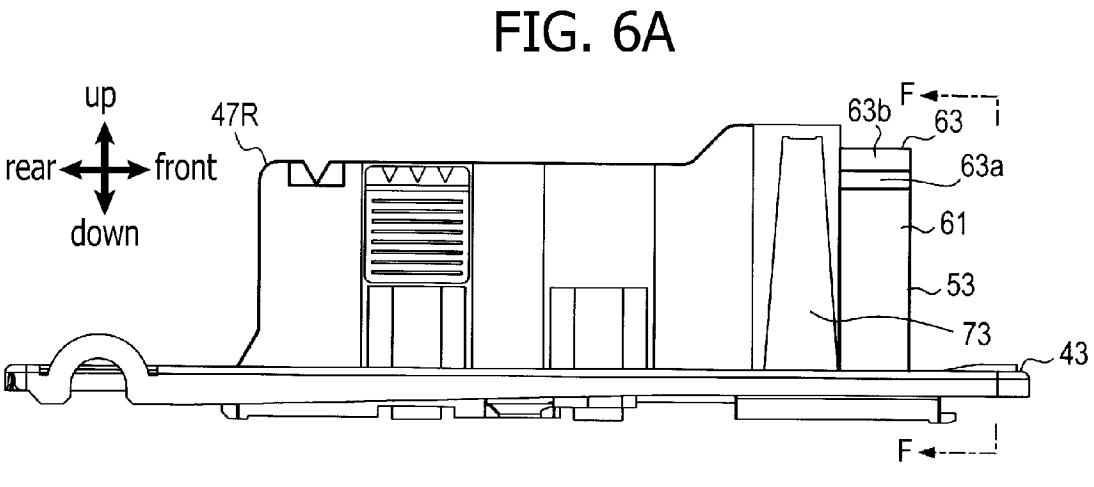
FIG. 6A
FIG. 6D
FIG. 6C

SHEET FEEDING DEVICE AND IMAGE FORMING APPARATUS

CROSS REFERENCE TO RELATED APPLICATION

This application claims priority from Japanese Patent Application No. 2010-019042, filed on Jan. 29, 2010, the entire subject matter of the which is incorporated herein by reference.

BACKGROUND

1. Technical Field

An aspect of the present invention relates to a sheet feeding device and an image forming apparatus with the sheet feeding device.

2. Related Art

An image forming apparatus with a sheet feeding device may have a mechanism to prevent the sheet feeding device from being overloaded with an excessive amount of recording sheets. For example, a sheet cassette, which can prevent itself from being installed in the image forming apparatus when an excessive amount of sheets are loaded therein, is suggested. The sheet cassette may be provided with a rotatable intercepting member with a hook, which is uplifted when the sheets are to be placed in the sheet cassette and lowered to become in contact with a topmost sheet in the sheet stack when placement of the sheets is completed. When height of the sheet stack exceeds acceptable height, the hook is restricted from being further lowered to the acceptable height. Therefore, the sheet feeding device interferes with the hook at the higher position, and the sheet cassette with the excessive amount of sheets is not installable in the sheet feeding device of the image forming apparatus. Thus, a user can be aware of the excessive amount of sheets in the sheet cassette, and the overloaded sheet cassette can be prevented from being installed in the sheet feeding device.

SUMMARY

However, the image forming apparatus configured as above may occasionally permit the cassette with the excessive amount of sheets to be installed. Because such a sheet cassette can have the intercepting member either in the uplifted position and the lowered position outside the image forming apparatus when the sheet cassette is removed, the sheet cassette may accept the sheet stack in any height. When the excessive amount of sheets is once accepted in the sheet cassette, and the user, either being aware or unaware of the overload, forcibly compress the sheet stack in the sheet cassette because the user may not note the overload at the time when the user places the sheet stack in the sheet cassette. When the excessive amount of sheets is forcibly installed, the hook of the intercepting member may be damaged. Even when the hook is substantially rigid, a bearing to rotatably support the intercepting member or other parts of the sheet cassette may be damaged.

In view of the above drawbacks, the present invention is advantageous in that an image forming apparatus, in which overload of sheets is prevented and the sheet cassette can be prevented from being damaged by the external force applied upon installation, is provided.

According to an aspect of the present invention, a sheet feeding device to feed a sheet in a feeding path is provided. The sheet feeding device includes a body, a sheet cassette configured to be attachable to and removable from the body and to accommodate a stack of sheets, a lifting plate configured to be arranged inside the sheet cassette to support the stack of sheets thereon, movable to an uplifted position when the sheet cassette is attached to the body and to a lowered position when the sheet cassette is outside the body, and to uplift the stack of sheets according to the movement thereof to the uplifted position, a feeder configured to become in contact with a topmost sheet in the stack of sheets in the sheet cassette when the sheet cassette is attached to the body and the lifting plate is in the uplifted position, to pick up and feed the topmost sheet in the feeding path, and a restrictive member provided to the sheet cassette and configured to be movable in association with the movement of the lifting plate, the restrictive member including a restricting part, which restricts a height of the stack of sheets accommodated in the sheet cassette. The restrictive member is in a restrictive position, in which at least the restricting part of the restrictive member is arranged over the stack of sheets accommodated in the sheet cassette, when the lifting plate is in the lowered position. The restrictive member is in a retracted position, in which the restrictive member is retracted off from the stack of sheets accommodated in the sheet cassette, when the lifting plate is in the uplifted position.

According to another aspect of the present invention, an image forming apparatus is provided. The image forming apparatus includes a body, a sheet cassette configured to be attachable to and removable from the body and accommodates a stack of sheets, a lifting plate configured to be arranged inside the sheet cassette to support the stack of sheets thereon, movable to an uplifted position when the sheet cassette is attached to the body and to a lowered position when the sheet cassette is outside the body, and uplifts the stack of sheets according to the movement thereof to the uplifted position, a restrictive member provided to the sheet cassette and configured to be movable in association with the movement of the lifting plate, the restrictive member including a restricting part, which restricts a height of the stack of sheets accommodated in the sheet cassette, a feeder configured to become in contact with a topmost sheet in the stack of sheets in the sheet cassette when the sheet cassette is attached to the body and the lifting plate is in the uplifted position, to pick up and feed the topmost sheet in a sheet feeding path, and an image forming unit configured to form an image on the sheet fed in the sheet feeding path. The restrictive member is in a restrictive position, in which at least the restricting part of the restrictive member is arranged over the stack of sheets accommodated in the sheet cassette, when the lifting plate is in the lowered position. The restrictive member is in a retracted position, in which the restrictive member is retracted off from the stack of sheets accommodated in the sheet cassette, when the lifting plate is in the uplifted position.

BRIEF DESCRIPTION OF THE ACCOMPANYING DRAWINGS

FIGS. 6A-6D illustrate a height-restrictive mechanism including a side guide, a restricting piece, and a lifting plate according to the first embodiment of the present invention.

DETAILED DESCRIPTION

Hereinafter, embodiments according to aspects of the present invention will be described with reference to the accompanying drawings.

First Embodiment

[Configuration of the Image Forming Apparatus]

Figure 1:
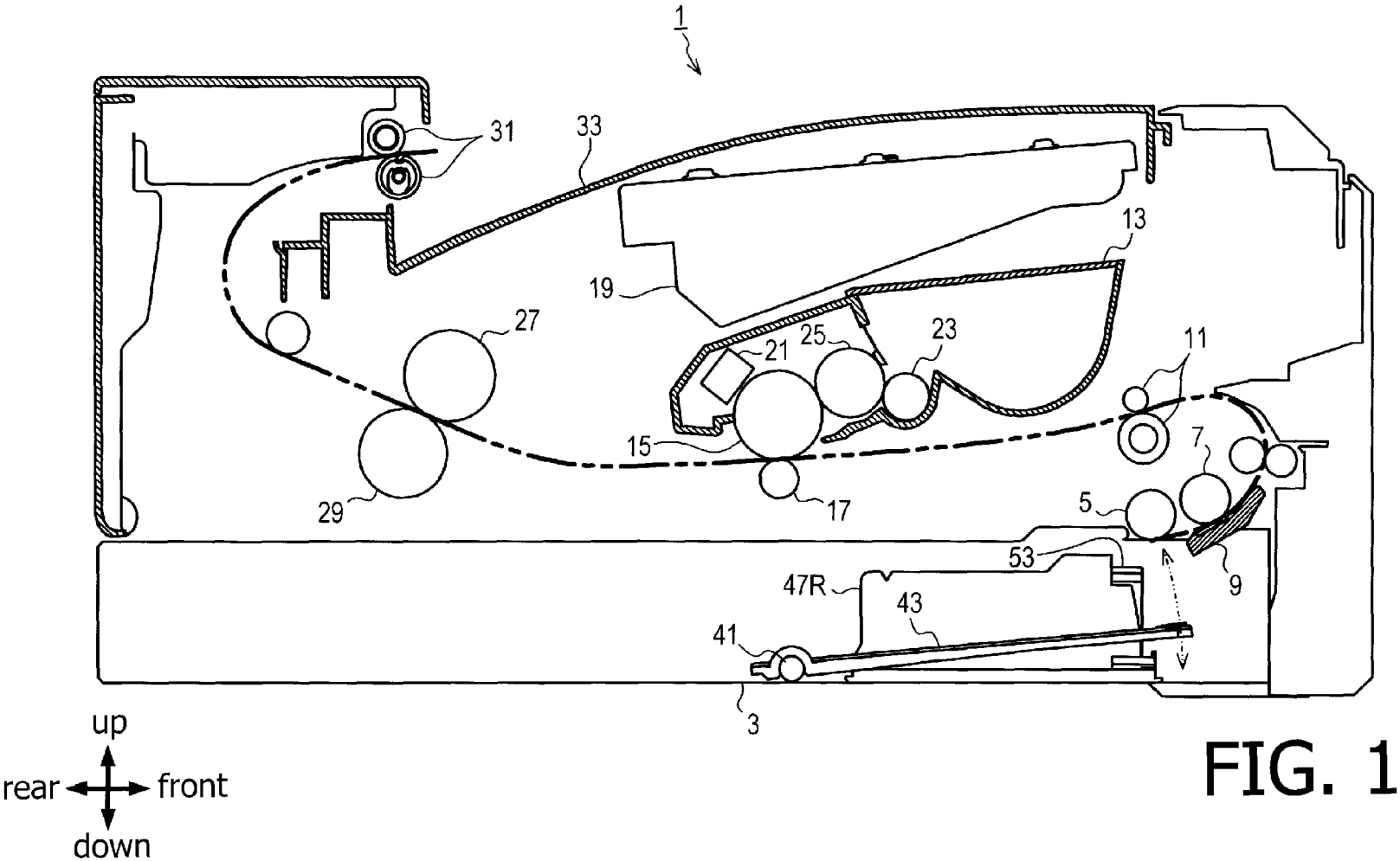
FIG. 1 is a cross-sectional side view of a printer according to a first embodiment of the present invention.

A printer 1 is an image forming apparatus for printing an image in an electro-photographic method and includes a sheet cassette 3, a processing cartridge 13, a laser scanner 19, and a discharge tray 33. The sheet cassette 3 can accommodate a stack of plurality of sheets, and the sheets stacked in the sheet cassette 3 are picked up one-by-one by a pickup roller 5, separated from the sheet stack by a separator roller 7 and a separator pad 9, and fed into a feeding path, which is indicated by a double-dotted line in FIG. 1.

When the sheet being conveyed reaches register rollers 11 and a front end of the sheet becomes in contact with the register rollers, the sheet is set in an optimized position so that an image is formed in a correct position on the sheet. As the sheet is set in the position, further, an orientation of the sheet with respect to a sheet-feeding direction is corrected. Thus, misalignment of the sheet in the feeding path is corrected.

The sheet is carried through the register rollers 11 and forwarded in the feeding path toward rear of the printer 1 to a position below the processing cartridge 13. There, the sheet is nipped between a photosensitive drum 15 and a transfer roller 17 to have a toner image, which is formed on a surface of the photosensitive drum 15, transferred thereon. The toner image is developed from a latent image, which is formed on the surface of the photosensitive drum 15 by the laser scanner 19.

More specifically, in the printer 1, the processing cartridge 13 includes a charger 21, a toner supplier roller 23, and a developer roller 25. The surface of the photosensitive drum 15 is charged by the charger 21, and the laser scanner 19 scans the charged surface according to image data to form a latent image. Meanwhile, a surface of the developer roller 25 is supplied with toner from the toner supplier roller 23. When the surface of the photosensitive drum 15 with the latent image becomes in contact with the toner-supplied developer roller 25, the toner on the toner supplier roller 25 is transferred onto the latent image on the photosensitive drum 15 to form a toner image. The toner image on the photosensitive drum 15 is transferred onto the sheet which is nipped between the photosensitive drum 15 and the transfer roller 17. Thus, the toner image is formed on the surface of the sheet.

The sheet with the toner image formed thereon is carried in the feeding path to a nipped position between a heat roller 27 and a pressure roller 29. As the sheet is conveyed through the heat roller 27 and the pressure roller 29, heat and pressure from the heat roller 27 and the pressure roller 29 are applied to the sheet. Thus, the toner image is fixed on the sheet. The sheet is further conveyed in the feeding path and directed to the discharge tray 33, which is arranged in a top section of the printer 1.

[Configuration of the Sheet Cassette]

Figure 2:
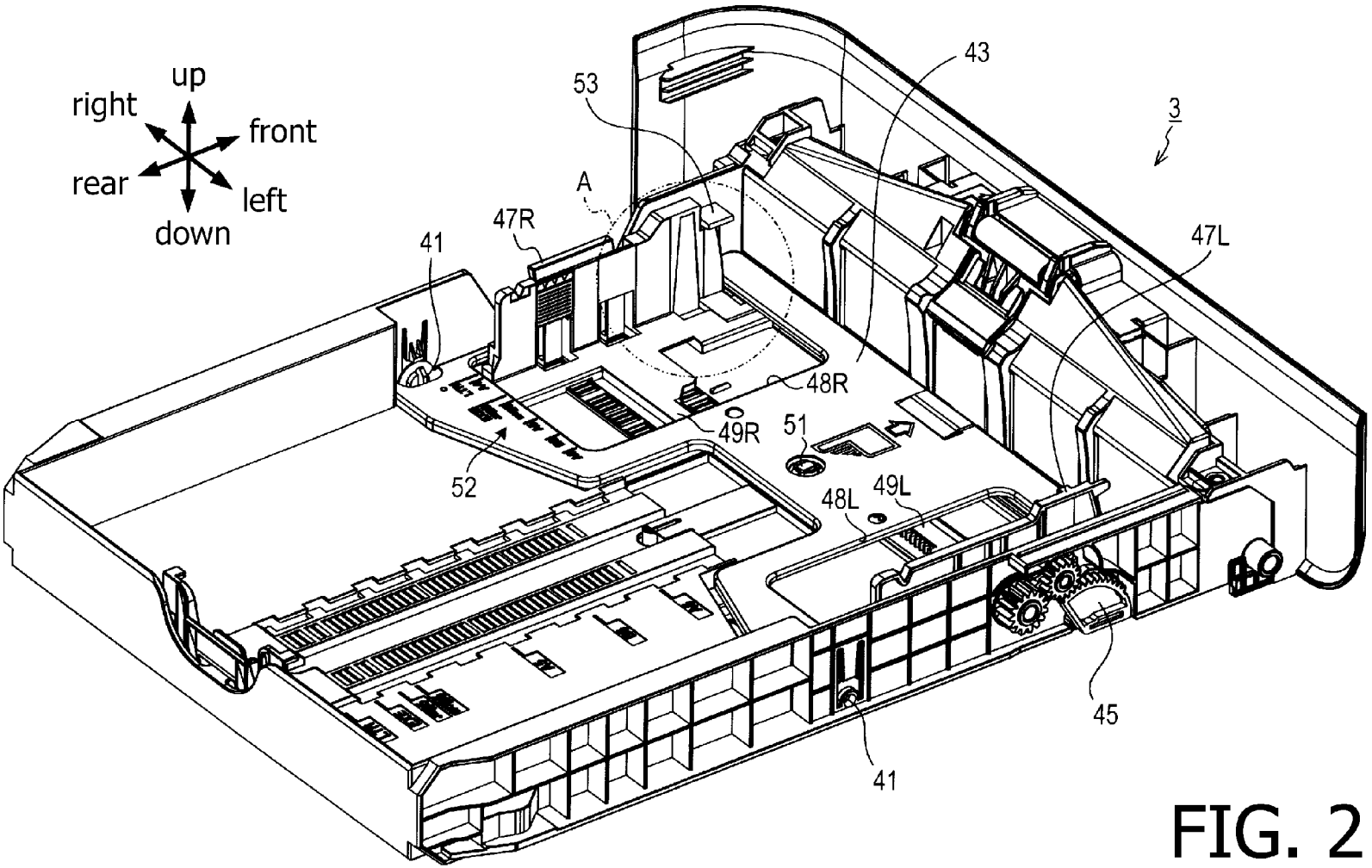
FIG. 2 is a perspective view of a sheet cassette to be installed in the printer according to the first embodiment of the present invention.

The sheet cassette 3 (see FIGS. 1 and 2) according to the present embodiment is removably installed in a body of the printer 1 and includes a lifting plate 43, which is rotatable about a rotation shaft 41. The lifting plate 43 is arranged inside the sheet cassette 3 to support the sheet stack thereon and is moved by driving force generated in a motor (not shown) being a power source, which is arranged in the printer 1. In particular, the sheet cassette 3 is equipped with gears 45, which are engageable with a gear system (not shown) provided to the printer 1 when the sheet cassette 3 is installed in the printer 1. Thus, transmission path to transmit driving force from the printer 1 to the sheet cassette 3 is established. When an image is formed, the driving force is transmitted to the gear system 43 to rotate the lifting plate 43 upward. Thus, the sheets stacked in the sheet cassette 3 are lifted upward by the lifting plate 43. When the sheet stack in the sheet cassette 3 is uplifted, a topmost sheet in the sheet stack is pressed to the pickup roller 5 and picked up according to rotation of the pickup roller 3. The sheet picked up by the pickup roller 3 is fed in the feeding path. The lifting plate 43 is lowered when the sheet cassette 3 is removed out of the body of the printer 1.

The sheet cassette 3 is provided with a pair of side guides, which are left side guide 47L and a right side guide 47R. The left and right side guides 47L, 47R are formed and arranged to uprise through openings 48L, 48R. The openings 48L, 48R are formed in the lifting plate 43 to allow the left and right side guides 47L, 47R protrude therethrough and enable smooth rotating motion of the lifting plate 43. Thus, the lifting plate 43 can be rotated upwardly without being interfered with by the side guides 47L, 47R.

The left and right side guides 47L, 47R are slidable in a left and right direction with respect to the sheet cassette 3. The left and right side guides 47L, 47R are formed to have racks 49L, 49R, which extend right ward and leftward respectively, to enable steady sliding movement of the left and right side guides 47L, 47R. The racks 49L, 49R are engaged with front and rear edges of a pinion 51, which is interposed between the rack 49L and the rack 49R.

According to the engagement of the racks 49L, 49R with the pinion 51, the left and right side guides 47L, 47R can slide in a widthwise direction in the sheet cassette 3 with a median point therebetween maintained steady to be fitted to crosswise ends of the sheets. When one of the left and right side guides 47L, 47R, e.g., the left side guide 47L, is slid in the widthwise direction, the left side guide 47L rotates the pinion 51. According to rotation of the pinion 51, the other of the left and right side guides 47L, 47R (e.g., the right side guide 47R) is slid in a direction opposite from the sliding direction of the left side guide 47L.

The lifting plate 43 has scale marks 52, which indicate widths of the sheets to be stored in the sheet cassette 3. Therefore, the left and right side guides 47L, 47R can be slid to move a desired amount to have the sheets therebetween with reference to the scale marks 52. With the left and right side guides 47L, 47R set in positions to have the desired amount of clearance therebetween, the sheets can be placed in the clearance. Thus, the sheets can be placed and maintained in the widthwise center in the sheet cassette 3.

The right side guide 47R is provided with a restrictive piece 53, which moves in the widthwise direction along with the sliding movement of the right side guide 47R.

[Restrictive Piece in Detail]

Figure 3B:
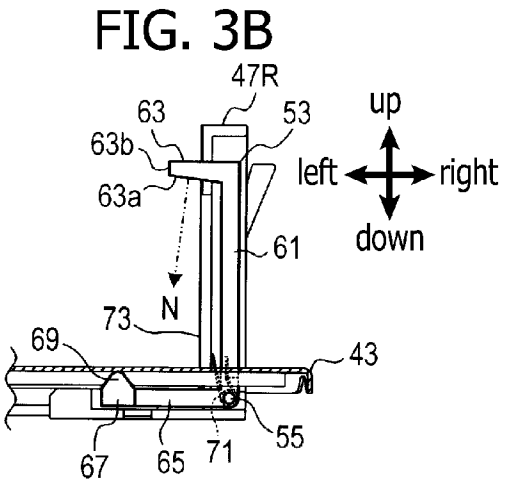
FIGS. 3A-3D illustrate a height-restrictive mechanism including a side guide, a restricting piece, and a lifting plate according to the first embodiment of the present invention.
Figure 3A:
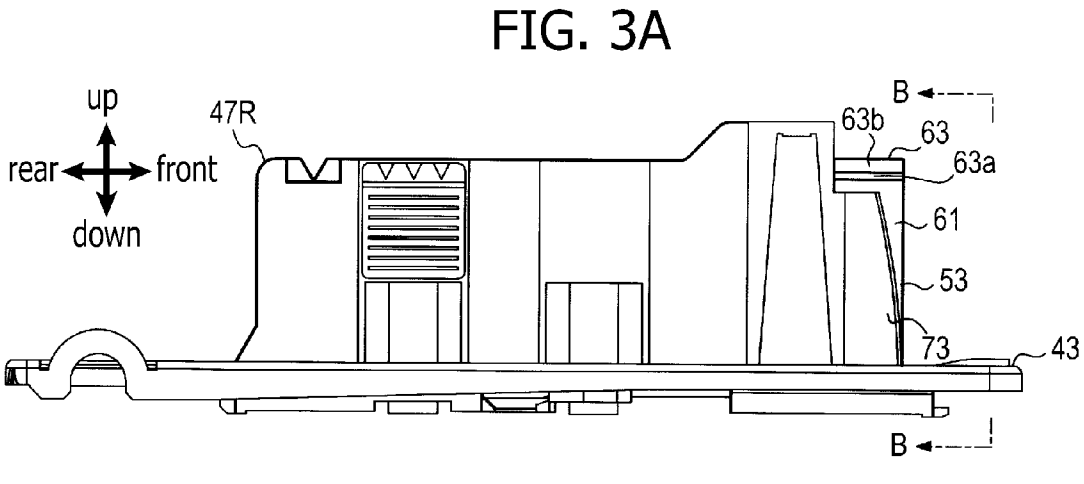
Figure 3D:
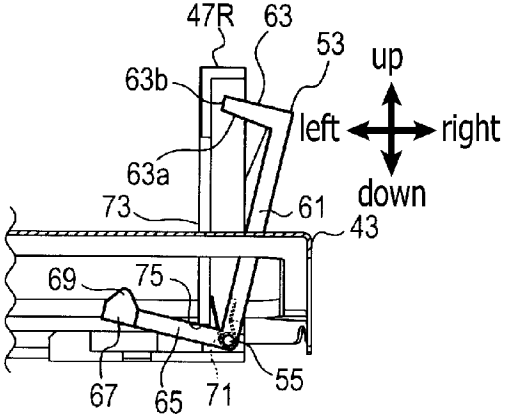
Figure 3C:
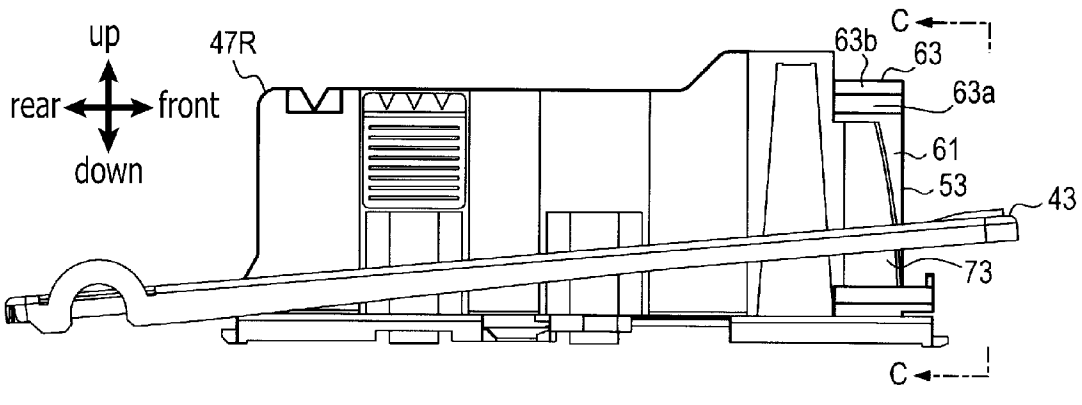

The restrictive piece 53, as shown in FIGS. 3A-3D, is rotatable with respect to the right side guide 47R about a shaft 55 between a restrictive position (see FIGS. 3A and 3B) and a retracted position (see FIGS. 3C and 3D).

The restrictive piece 53 includes an uprising section 61 and a left-extending section 65, which extend from the shaft 55 respectively in different directions. The uprising section 61 extends upward from the shaft 55 when the restrictive piece 53 is in the restrictive position. The left-extending section 63 extends leftward from the shaft 55 when the restrictive piece 53 is in the restrictive position. In other words, the uprising section 61 and the left-extending section 63 are connected via the shaft 55. A claw 63 extends leftward from an upper end of the uprising section 61. The restrictive piece 53 further includes a front-extending section 67, which extends frontward from a left-end of the left-extending section 65, and a contact section 69, which protrudes upward from a front end of the front-extending section 67.

The restrictive piece 53 is provided with a spring 71, which resiliently urges the restrictive piece 53 to rotate about the shaft 55 to the retracted position, in the vicinity of the shaft 55. When the lifting plate 43 is in a lowered position (see FIGS. 3A and 3B), the restrictive piece 53 is suppressed in the retracted position with the contact section 69 being in contact with the lifting plate 43 and pressed downward by the lifting plate 43 against the resilient force from the spring 71. When the lifting plate 43 is in an uplifted position (see FIGS. 3C and 3D), the contact section 69 is released from the pressure of the lifting plate 43, and the restrictive piece 53 is urged to rotate by the resilient force of the spring 71 to the retracted position.

Figure 4:
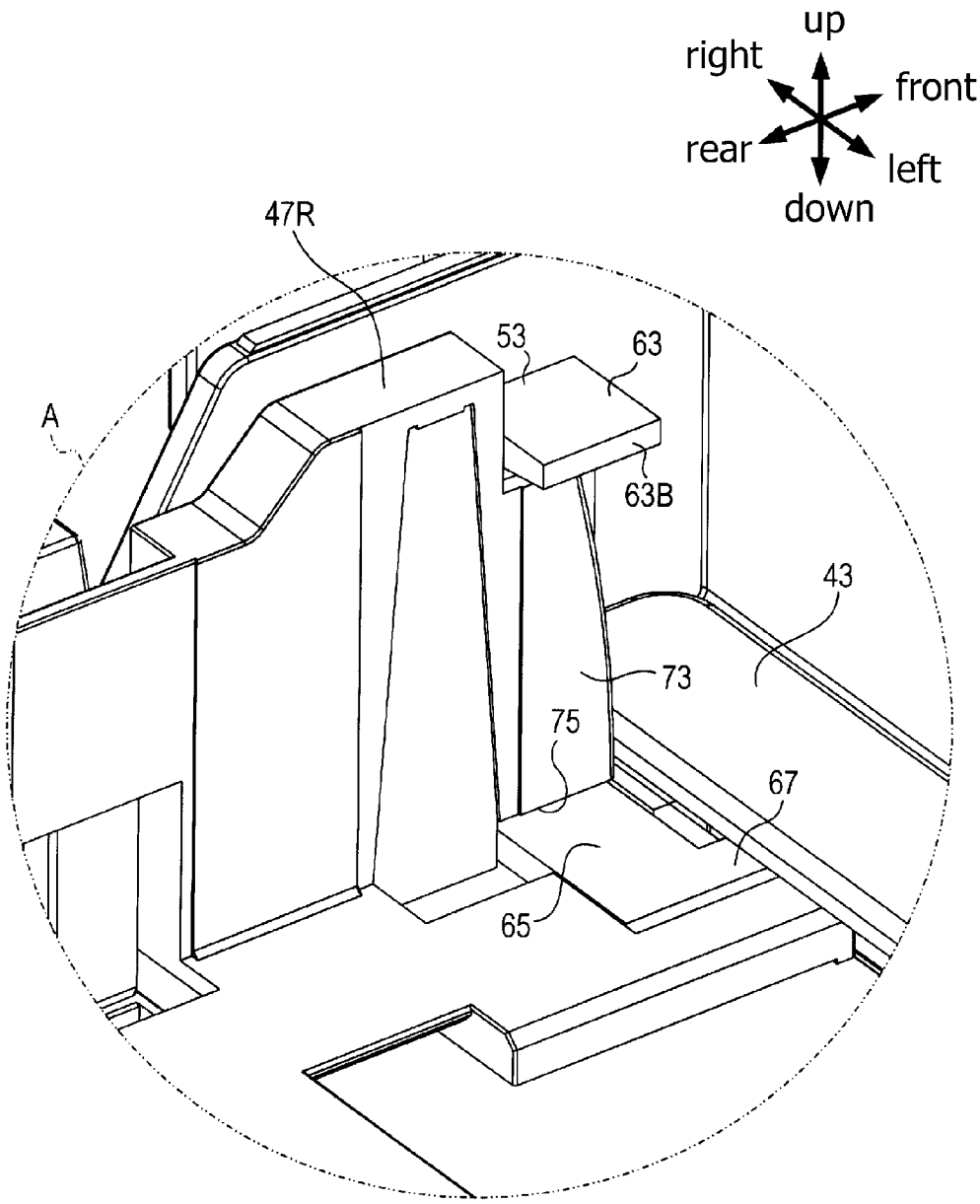
FIG. 4 illustrates an enlarged view of an encircled area A in FIG. 2.

When the sheet cassette 3 is removed out of the printer 1, the lifting plate 43 is brought in the lowered position, and the restrictive piece 53 is brought in the restrictive position. In the restrictive position, the restrictive piece 53 has the claw 63 protruding inward (i.e., leftward from an inner surface 73 of the right side guide 47R) (see FIGS. 3A, 3B, and 4). Therefore, with the claw 63 protruding inward, when the sheets are placed in the sheet cassette 3 with the left-side edges thereof being in contact with the inner surface 73 of the right side guide 47R, the claw 63 protrudes over the sheets. When height of the sheets placed in the sheet cassette reaches a maximum allowable height in the sheet cassette 3, a topmost sheet in the sheet stack becomes in contact with a lower surface 63*a* of the claw 63. When the user attempts to place an excessive amount of sheets exceeding a height of the claw 63, the user should find the excessive amount of sheets being interfered with by the claw 63 protruding over the allowable height of sheets. In this regard, the user should find the excessive amount of sheets is not accepted in the sheet cassette 3 before placement of the sheet stack is settled in the sheet cassette 3. Thus, the user can adjust the amount of sheets to be set in the sheet cassette 3 with reference to the height of the claw 63, which is steadily in the restrictive position when the sheet cassette 3 is outside the printer 1, and the height of the sheet stack can be maintained to be lower than the lower surface 63*a* of the claw 63.

Meanwhile, when the sheet cassette 3 is installed in the printer 1 and when an image is formed on the sheets, the lifting plate 43 is uplifted by the driving force transmitted through the gears 45. Accordingly, the restrictive piece 53 is shifted from the restrictive position to the retracted position (see FIGS. 3C and 3D). When the restrictive piece 53 is in the retracted position, the claw 63 is retracted in the right-hand side of the right side guide 47R off from the sheets in the sheet cassette 3. Therefore, the sheet being picked up by the pickup roller 5 is not interfered with by the restrictive piece 53 but is fed in the feeding path smoothly. In this regard, an upper edge of the left-extending section 65 becomes in contact with a lower edge 75 (see FIGS. 3D and 4) of the right side guide 47R, and the restrictive piece 53 is prevented from being rotated and retracted further.

When the restrictive piece 53 is shifted to the retracted position, the claw 63 is shifted to have a left-side open end thereof moving from a position on a left side of the shaft 55 to a position substantially right above the shaft 55. In this regard, according to the rotation of the restrictive piece 53, the claw 63 is moved with a top level thereof transiently raised before the claw 63 is situated in the retracted position.

Meanwhile, if the restrictive piece 53 is configured to shift rightward with the top level thereof steadily maintained, when the sheets on the lifting plate 43 are upraised along with the lifting plate 43, the upraised sheets may interfere with the claw 63 being shifted. Therefore, with the claw 63 which is moved upward according to the rightward shifting motion, the restrictive piece 53 can shift in the retracted position without being interfered with by the upraised sheets on the lifting plate 43.

The claw 63 according to the present embodiment includes a lower surface 63*a*, which faces the sheets when the restricting piece 53 is in the restrictive position. The lower surface 63*a* is formed to incline with respect to a horizontal line with its left-side open end being higher than its right-side end which is connected to the uprising 61. Therefore, the lower surface 63*a* has a normal line N thereof being directed to lower left when the restrictive piece 53 is in the restrictive position.

With the inclined shape, the lower portion of the lower surface 63*a*, which is closer to the uprising section 61, withdraws to a right side of the inner surface 73 of the right side guide 47R earlier, and a remaining higher portion, which is closer to the open end of the claw 63, is upraised to prevent interference with the sheets. Therefore, restrictive piece 53 can be smoothly shifted to the retracted position without claw 63 being interfered with by the sheets uplifted by the lifting plate 43.

In other words, with the transient uprising movement of the claw 63, which is caused due to the positional relation of the claw 63 and the shaft 55, and the inclination of the lower surface 63*a*, the claw 63 is shifted in a direction to be apart from the sheet to prevent the interference with the sheet, and the restrictive piece 53 is allowed to smoothly move in the retracted position.

When the claw 63 is situated in the retracted position, the claw 63 is withdrawn to the right side of the inner surface 73 of the right side guide 47R. In this position, the claw 63 does not interfere with the sheets being uplifted by the lifting plate 43. Further, when the sheet cassette 3 is in the position to supply the feeding path with the sheets, the sheets are picked up from the sheet cassette 3 by the pickup roller 5 without being interfered with by the claw 63 in the retracted position.

According to the present embodiment, when the sheet cassette 3 is removed out of the printer 1, the gears 45 in the sheet cassette 3 are disengaged from the gears (not shown) in the printer, the lifting plate 43 descends to a bottom level of the sheet cassette 3 by its own weight. However, the lifting plate 43 may not necessarily descend in accordance with removal of the sheet cassette 3 out of the printer 1. For example, the lifting plate 43 may be lowered by rotation of the gears, which can be driven upon completion of image printing in the printer 1. In any way, when the lifting plate 43 is lowered, the restrictive piece 53 is shifted from the retracted position to the restrictive position. In this regard, the left-side open end of the claw 63 may be in contact with the side of the sheet stack and inserted between the sheets in the sheet stack. Therefore, the claw 63 is formed to have a knocking surface 63*b*, which prevents the claw 63 from being inserted between the sheets in the sheet stack.

In particular, when the claw 63 is viewed from front (see FIGS. 3B and 3D), if the claw 63 is formed to have the left-side open end in a pointing shape, the pointed end may be easily inserted between the sheets when the restrictive piece 53 is shifted to the restrictive position. Therefore, the claw 63 is formed to have the knocking surface 63*b*, of which height is greater than height of assumable interstices in the sheet stack, so that the knocking surface 63*b* is not allowed to enter the interstice.

[Effects]

As has been described above, according to the printer 1 in the present embodiment, the restrictive piece 53 in the restrictive position restricts the sheets from being stacked in the sheet cassette 3 beyond an acceptable level, and the restrictive piece 53 is in the restrictive position when the sheet cassette 3 is removed out of the printer 1. Therefore, unlike a sheet feeding device without the restricting piece 53, or unlike a sheet feeding device with a restricting member which can be either in the restrictive position and the retracted position outside the printer to accept the sheet stack in any height, loading an excessive amount of sheets in the sheet cassette 3 can be effectively prevented before the sheet stack is settled in the sheet cassette 3.

In the printer 1, further, the restrictive piece 53 in the retracted position does not conflict with the sheets being picked up by the pickup roller 5. Therefore, unlike a sheet feeding device with a restrictive piece fixed to a predetermined restrictive position, the sheets being picked up are not interfered with by the restrictive piece 53 but smoothly fed in the feeding path.

Furthermore, in the printer 1, lifting force to drive the lifting plate 43 upward is required to be substantially large to uplift the sheet stack to the pickup roller 5. In other words, as long as the lifting plate 43 can be lifted, and the restrictive piece 53 can be manipulated by the lifting plate 43, the restrictive piece 53 may be configured to avoid excessive external force from being applied. In particular, according to the above embodiment, the lifting plate is uplifted by a driving source (not shown) in the printer 1, whilst the restrictive piece 53 is shifted by the external force applied from the lifting plate 43 being uplifted. Therefore, unlike conventional sheet-restricting structures, which are subject to various levels of external forces caused by a user upon installation of the sheet cassette, the sheet cassette 3 in the present embodiment can avoid the restrictive piece 53 and other surrounding components from being damaged by unexpected excessive external force upon installation.

Moreover, the restrictive piece 53 is shifted in association with the lifting plate 43, which is employed in a conventional sheet cassette. Therefore, installation of specific components, which are different from the lifting plate 43, to manipulate the restrictive piece 53 newly is not necessary, and large increase of a quantity of the newly employed components for restricting the sheet height in the sheet cassette 3 can be avoided.

In the above embodiment, when the restrictive piece 53 moves from the retracted position to the restrictive position, the restrictive piece 53 is manipulated by the force from the lifting plate 43. When the restrictive piece 53 moves from the restrictive position to the retracted position, on the other hand, the restrictive piece 53 is shifted by the resilient force from the spring 71. In other words, the restrictive piece 53 can be shifted without the force from the lifting plate 43. Thus, unlike a restrictive member, which is moved from the restrictive position to the retracted position, and vice versa, by using external force from the lifting plate, according to the above embodiment, at least one of the shifting motions can be effectively achieved by using the force from the spring 71.

In the above embodiment, when the restrictive piece 53 rotates about the shaft 55 to shift from the restrictive position to the retracted position, the claw 63 is transiently moved upward. Therefore, unlike a restrictive piece which shifts to the retracted position without moving upward, the restrictive piece 53 according to the embodiment can shift in the retracted position smoothly without being interfered with by the upraised sheets on the lifting plate 43.

In the above embodiment, the claw 63 is formed to have the inclined lower surface 63*a*. Therefore, the restrictive piece 53 can be shifted to the restrictive position more smoothly. Further, when a maximum allowable amount of sheets is stacked in the sheet cassette 3, although a topmost sheet in the sheet stack may be in contact with the lowest part of the lower surface 63*a*, clearance is reserved between the highest part of the lower surface 63*a* and the topmost sheet. Accordingly, the sheets can be set in the sheet cassette 3 more smoothly, and the sheet cassette 3 can be filled even by the maximum allowable amount of sheets easily.

Second Embodiment

Next, a second embodiment of the invention will be described. In the embodiments described below, configurations similar to those in the first embodiment will be referred to by the identical reference signs, and description of those will be omitted.

[Restrictive Piece in Detail]

In the second embodiment, a position of the shaft 55 (see FIGS. 5A-5D) of the restrictive piece 53 is different from that of the shaft 55 in the first embodiment. In particular, the shaft 55 is in a position displaced rightward with respect to a lowermost part of the uprising section 61 whilst the shaft 55 of the restrictive piece 53 in the first embodiment is located in the lowermost part of the uprising section 61.

With the shaft 55 in the displaced position, distance between the shaft 55 and the left-side open end of the claw 63 is greater than that of the restrictive piece 53 in the first embodiment. When the restrictive piece 53 shifts from the restrictive position to the retracted position, the left-side open end of the claw 63 is rotated in a greater radius and moved upwardly for a greater amount. Therefore, with the shaft 55 in the position displaced to the direction of rotation (i.e., rightward in FIGS. 5B, 5D) of the restrictive piece 53, the sheets on the lifting plate 43 are more securely prevented from being interfered with by the claw 63, or at least increase of contact pressure between the sheets and the claw 63 can be prevented.

Figure 5A:
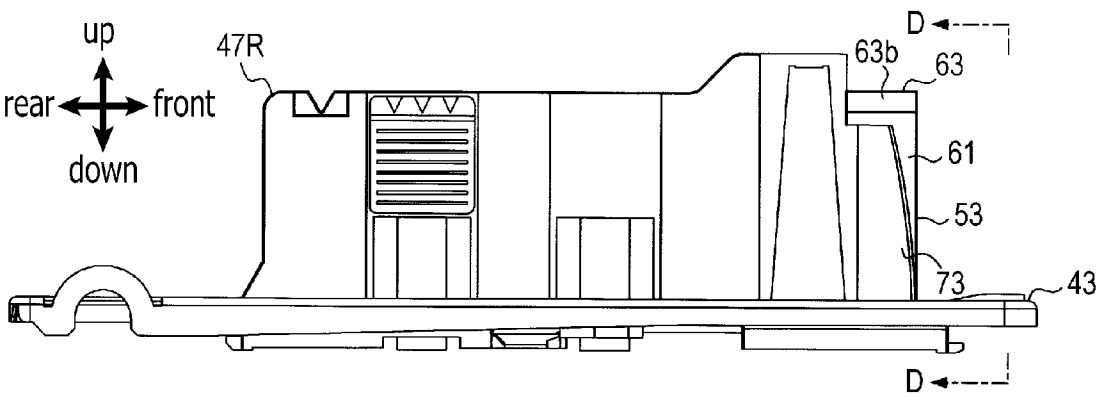
FIGS. 5A-5D illustrate a height-restrictive mechanism including a side guide, a restricting piece, and a lifting plate according to a second embodiment of the present invention.
Figure 5B:
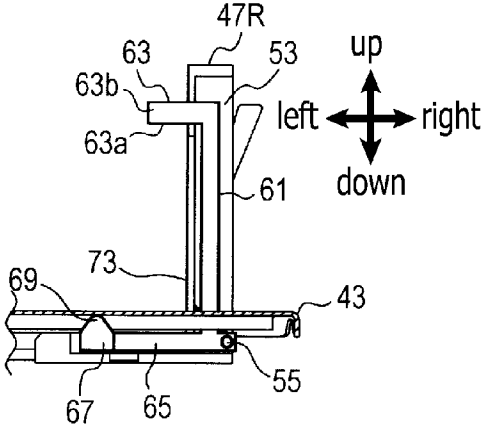
Figure 5C:
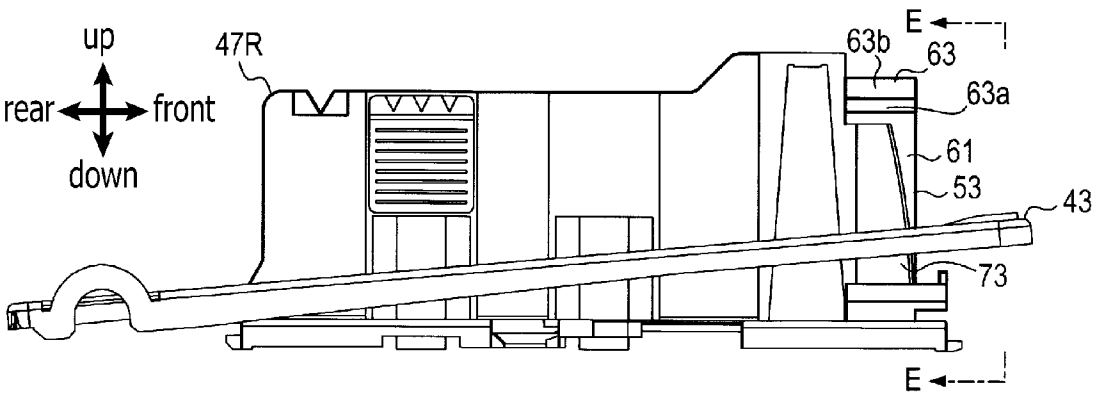
Figure 5D:
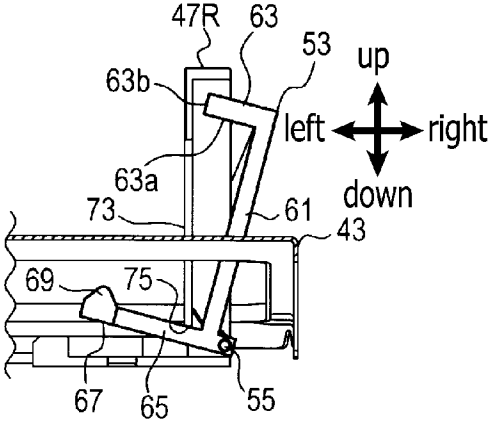

With the claw 63 which can be rotated in a greater radius and moved upwardly for a greater amount, therefore, the lower surface 63*a* of the claw 63 may not necessarily formed to incline with respect to the horizontal line but may be parallel to the horizontal line (see FIGS. 5B, 5D).

[Effects]

According to the restrictive piece 53 in the second embodiment, additionally to the functionalities provided by the restrictive piece 53 in the first embodiment, interference with the sheets on the lifting plate 43 can be more securely prevented or at least moderated, and the sheets can be securely uplifted to the sheet feeding position in the printer 1.

Third Embodiment

Next, a third embodiment of the invention will be described with reference to FIGS. 6A-6D. The restrictive piece 53 in the third embodiment is configured to be shifted from the restrictive position to the retracted position by a mechanism, which is different from that of the restrictive piece 53 in the first and second embodiments. In particular, whilst the restrictive piece 53 in the first and second embodiments are moved to the restrictive position by the resilient force of the spring 71, in the third embodiment, the uprising sheets on the lifting plate 43 shift the restrictive piece 53 to the retracted position.

Therefore, in the restrictive piece 53 in the third embodiment, the claw 63 is formed to have greater inclination in the lower surface 63*a* with respect to the horizontal line than the inclination of the lower surface 63*a* in the first embodiment.

In other words, the lower surface 63*a* is formed to be lower at the right-side end and higher at the left-side end, and the lowermost portion of the lower surface 63*a* is lower than the lowermost portion of the lower surface 63*a* of the first embodiment. In this configuration, the topmost sheet in the sheet stack uplifted by the lifting plate 43 becomes in contact with the lower surface 63*a*, the sheets pushes the claw 63 upwardly. As the sheets are uplifted further, the topmost sheet slides along the lower surface 63*a*, and the restrictive piece 53 is rotated in the clockwise direction (in FIGS. 6B, 6D) to be shifted in the retracted position.

[Effects]

According to the restrictive piece 53 in the third embodiment, similarly to the functionalities provided by the restrictive piece 53 in the first and second embodiments, the sheets can be securely uplifted to the sheet feeding position in the printer 1. Further, in the restrictive piece 53 in the third embodiment, the sprint 71 to move the restrictive piece 53 from the restrictive position to the retracted position can be omitted, and a quantity of the components in the sheet cassette 3 can be reduced.

More Examples

Although examples of carrying out the invention have been described, those skilled in the art will appreciate that there are numerous variations and permutations of the sheet feeding device and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the spring 71 in the first and second embodiment, which is a compressed spring to move the restrictive piece 53 in the restrictive position to the retracted position, may be replaced with a stretched spring pulling the restrictive piece 53 to rotate.

For another example, in the first and second embodiments, the restrictive piece 53 in the restrictive position compresses the spring 71, and the resilient force of the spring 71 moves the restrictive piece 53 to the retracted position. However, the restrictive piece 53 may be pushed to the restrictive position by resilient force of a spring, and the restrictive piece 53 may be moved to the retracted position against the resilient force of the spring by, for example, driving force of gears (not shown), which are associated with uprising movement of the lifting plate 43.

A material or a form for the spring 71 is not limited but may be, for example, metal or resin, and a leaf, a torsion bar, or a coil. In the above embodiments, the spring 71 is provided separately from the restrictive piece 53. However, a spring integrally formed with the restrictive piece 53 may be employed. For example, the spring and the restrictive piece may be formed integrally in resin.

In the above embodiments, the restrictive piece 53 is provided solely to the right side guide 47R. However, the restrictive piece 53 may be provided solely to the left side guide 47L or to both of the right and left side guides 47R, 47L.

What is claimed is:

1. A sheet feeding device to feed a sheet in a feeding path, comprising:

a body;

a sheet cassette configured to be attachable to and removable from the body and to accommodate a stack of sheets, the sheet cassette comprising;

a lifting plate arranged inside the sheet cassette to support the stack of sheets thereon, to be moved to an uplifted position after the sheet cassette is attached to the body and when printing is executed, and maintained at a lowered position after the sheet cassette is attached to the body and until the printing is executed, and to uplift the stack of sheets according to the movement of the lifting plate to the uplifted position; and a restrictive member configured to be movable in association with the movement of the lifting plate, the restrictive member including a restricting part, which restricts a height of the stack of sheets accommodated in the sheet cassette, wherein the restrictive member is in a restrictive position, in which at least the restricting part of the restrictive member is arranged over the stack of sheets accommodated in the sheet cassette, when the lifting plate is in the lowered position; and wherein the restrictive member is in a retracted position, in which the restrictive member is retracted off from the stack of sheets accommodated in the sheet cassette, when the lifting plate is in the uplifted position.

2. The sheet feeding device according to claim 1, wherein the lifting plate is driven to move upwardly and downwardly by driving force from a power source when the sheet cassette is attached to the body;

wherein the restrictive member is moved according to the movement of the lifting plate by external force applied from one of the lifting plate being driven and a movable member, which moves along with the lifting plate.

3. The sheet feeding device according to claim 1, wherein the restrictive member comprises a claw section being the restricting part at one end thereof and a contact section, which is in contact with the lifting plate when the lifting plate is in the lowered position, at the other end thereof; and wherein the restrictive member is rotatable about an axis, which is in a connecting portion connecting the claw section and the contact section.

4. The sheet feeding device according to claim 3, further comprising an urging member configured to resiliently move the restrictive member from one of the restrictive position and the retracted position to the other of the restrictive position and the retracted position, wherein the restrictive member is moved to the one of the restrictive position and the retracted position against the resilience of the resilient member from the other of the restrictive position and the retracted position when the external force is applied from the one of the lifting plate and the movable member; and wherein the restrictive member is moved from the one of the restrictive position and the retracted position to the other of the restrictive position and the retracted position by the resiliency of the resilient member when the restrictive member is released from the external force.

5. The sheet feeding device according to claim 3, wherein the claw section is transiently moved upwardly when the restrictive member is moved from the restrictive position to the retracted position.

6. The sheet feeding device according to claim 5, wherein the axis is arranged in a position to move the claw section transiently upwardly when the restrictive member is moved from the restrictive position to the retracted position.

7. The sheet feeding device according to claim 3, wherein the claw section comprises an inclined surface, which faces the stack of sheets accommodated in the sheet cassette when the restrictive member is in the restrictive position and is inclined with respect to the sheets in the stack; and wherein the inclined surface is inclined to be closer to the sheets in the stack at a part closer to the connected end of the claw section and further from the sheets in the stack at a part closer to the open end of the claw section.

8. The sheet feeding device according to claim 7, wherein the open end of the claw section comprises a knocking surface, which prevents the claw section from being inserted between the sheets accommodated in the sheet cassette.

9. An image forming apparatus, comprising:

a body;

a sheet cassette configured to be attachable to and removable from the body and to accommodate a stack of sheets, the sheet cassette comprising;

a lifting plate arranged inside the sheet cassette to support the stack of sheets thereon, to be moved to an uplifted position after the sheet cassette is attached to the body and when printing is executed and maintained at a lowered position after the sheet cassette is attached to the body and until the printing is executed, and to uplift the stack of sheets according to the movement of the lifting plate to the uplifted position;

a restrictive member configured to be movable in association with the movement of the lifting plate, the restrictive member including a restricting part, which restricts a height of the stack of sheets accommodated in the sheet cassette; and an image forming unit configured to form an image on the sheet fed in the sheet feeding path, wherein the restrictive member is in a restrictive position, in which at least the restricting part of the restrictive member is arranged over the stack of sheets accommodated in the sheet cassette, when the lifting plate is in the lowered position; and wherein the restrictive member is in a retracted position, in which the restrictive member is retracted off from the stack of sheets accommodated in the sheet cassette, when the lifting plate is in the uplifted position.

10. The image forming apparatus according to claim 9, wherein the lifting plate is driven to move upwardly and downwardly by driving force transmitted from a power source in the body through a transmission path, which is established when the sheet cassette is attached to the body.

11. An image forming apparatus, comprising:

a body;

a sheet cassette configured to be inserted into and removed from the body, and to accommodate a stack of sheets; the sheet cassette including a restrictive member including a restricting part configured to restrict a height of the stack of sheets when the restrictive member is in a restricting position, wherein the restrictive member is configured to:

change from the restricting position to a retracted position when the sheet cassette is inserted into the body and in response to execution of printing; and change from the retracted position to the restricting position after the sheet cassette is inserted into the body and until the printing is executed.

12. The image forming apparatus of claim 11, wherein the restrictive member includes an axis of rotation, a first section extending in a direction parallel to the sheets in the stack of sheets when the restrictive member is in the restrictive position, and a second section extending in a direction of the stack height and perpendicular to the sheets when the restrictive member is in the restrictive position, wherein the second section is offset from, and does not intersect, the axis of rotation.

13. The sheet feeding device of claim 1, wherein the restrictive member serves as a stack height limit.

14. The sheet feeding device of claim 1, wherein the restrictive member includes an axis about which the restrictive member pivots to move between the restrictive and retracted positions, and wherein the axis is parallel to a sheet feed direction of the sheet cassette.

15. The sheet feeding device of claim 1, wherein the restrictive member is configured to change positions based on a width of a sheet in the stack.

16. The sheet feeding device of claim 1, further comprising at least one side guide configured to slide in a widthwise direction of the sheets in the sheet cassette to accommodate the width of the sheets, and wherein the restrictive member is configured to move in the widthwise direction along with the side guide.

17. The sheet feeding device of claim 1, wherein the lifting plate includes an opening, and wherein the restrictive member includes a first portion that extends through the opening, and a second portion that extends under the lifting plate.

* * * * *